United States Patent [19]

Schuller et al.

[11] 4,286,703

[45] Sep. 1, 1981

[54] COIN TESTING AND SORTING APPARATUS

[75] Inventors: James T. Schuller, St. Louis County; Harry C. Haeusser, High Ridge, both of Mo.

[73] Assignee: UMC Industries, Inc., Stamford, Conn.

[21] Appl. No.: 38,088

[22] Filed: May 11, 1979

[51] Int. Cl.[3] ..... G07F 3/00

[52] U.S. Cl. ..... 194/100 A; 133/3 D; 194/1 K; 194/DIG. 14

[58] Field of Search ..... 194/1 F, 1 K, 1 G, 1 M, 194/1 N, 97 R, 100 A, 101, DIG. 1, DIG. 14; 133/2, 3 R, 3 D, 4 R, 4 A

[56] References Cited

U.S. PATENT DOCUMENTS

| | | | |
|---|---|---|---|
| 3,242,932 | 3/1966 | Becker | 133/3 R X |
| 3,717,233 | 2/1973 | Ovsienko | 194/101 |
| 3,844,297 | 10/1974 | Lautzenhiser | 133/3 D X |
| 3,889,792 | 6/1975 | Willis | 194/1 K |
| 3,916,922 | 11/1975 | Prumm | 133/3 R |
| 4,106,610 | 8/1978 | Heiman | 194/97 R |

FOREIGN PATENT DOCUMENTS

| | | | |
|---|---|---|---|
| 2824834 | 12/1978 | Fed. Rep. of Germany | 133/3 D |
| 47-18007 | 6/1972 | Japan . | |

*Primary Examiner*—F. J. Bartuska

*Attorney, Agent, or Firm*—Senniger, Powers, Leavitt and Roedel

[57] ABSTRACT

For use in a vendor for handling acceptable coins and rejecting unacceptable items (slugs, unacceptable coins) inserted in the coin slot of the vendor and for making change: coin apparatus for handling coins of various denominations (e.g., U.S. nickels, dimes, quarters and dollars), having change tubes for change coins of different denominations (e.g., nickels, dimes, quarters and dollar coins), in which coins of each of said change coin denominations inserted in the coin slot of the vendor are delivered to the respective change tube as long as the latter is not filled to a predetermined level, in which coins of each change coin denomination inserted in the coin slot of the vendor are delivered to the money box of the vendor when the tube for coins of that denomination is filled to the respective predetermined level, and in which unacceptable items are rejected.

25 Claims, 19 Drawing Figures

53
55
9
12
1
61
59
CP1
37
33
123
35
CP2
65
43
45
57
7
8
12
41
25
93
77
CP4
7
93
123
CP3
117
87
123
9
119
111
115
19
8
DT
DCT
QT
NT
CP4
CP2
61
CP3
59

9
115
17
15
13
1
119
109
64
45
41
43
49

FIG. 8
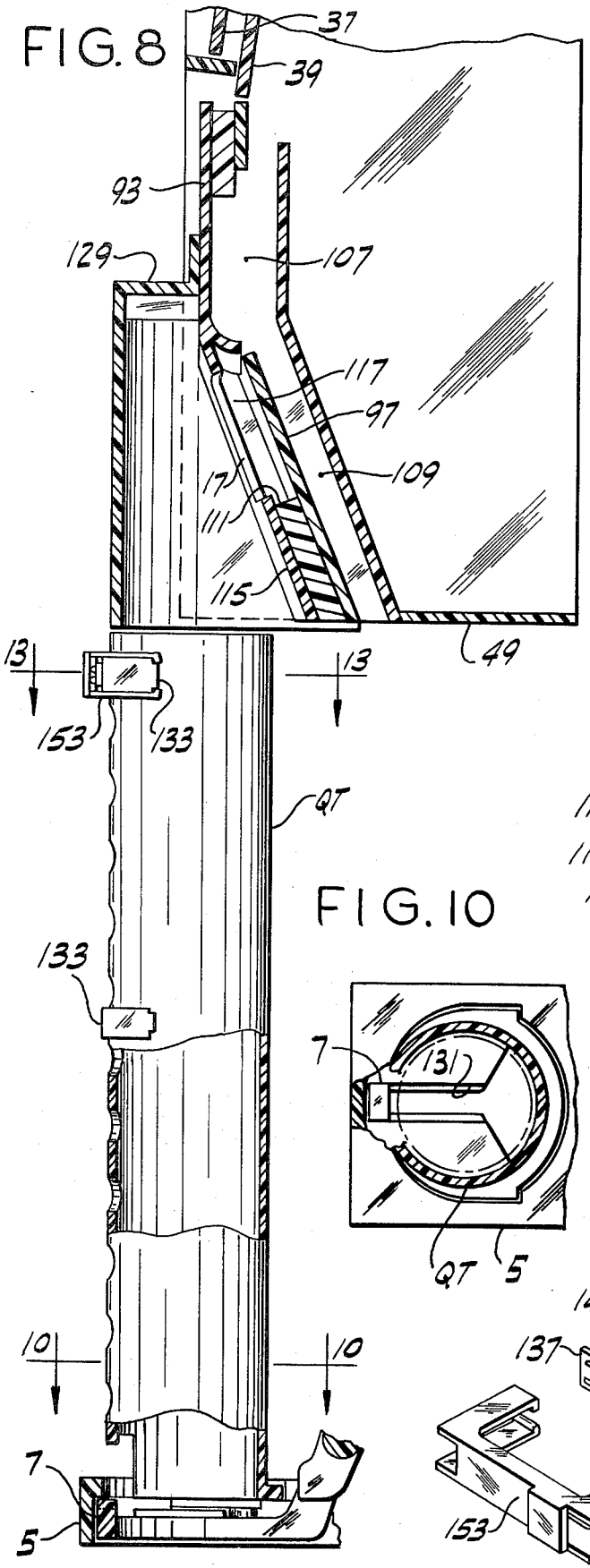
FIG. 9
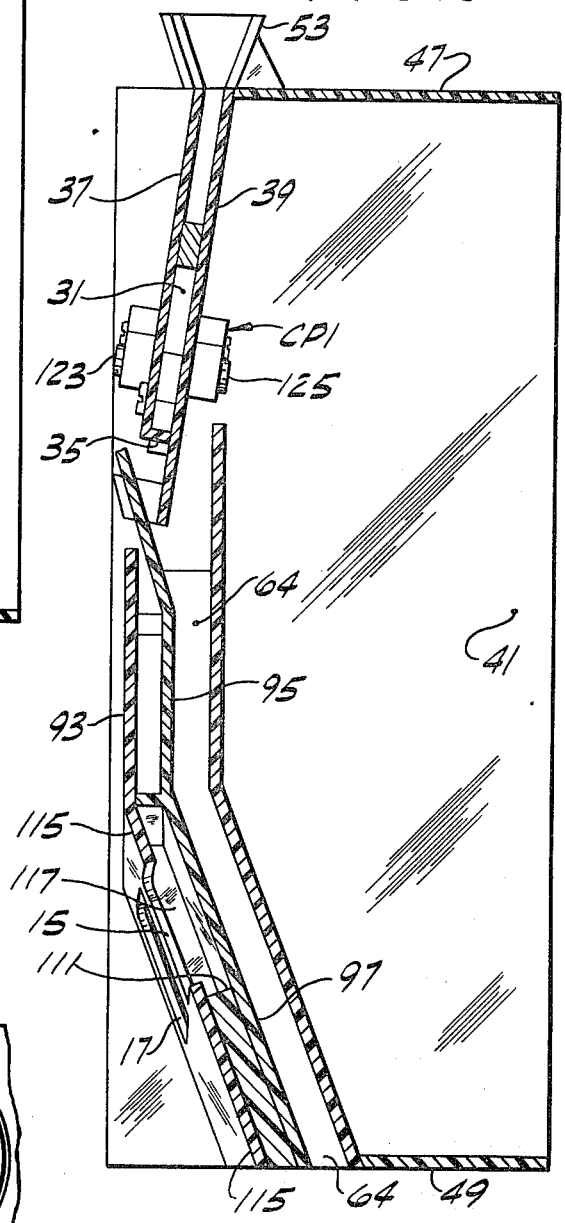
FIG. 10
FIG. 11
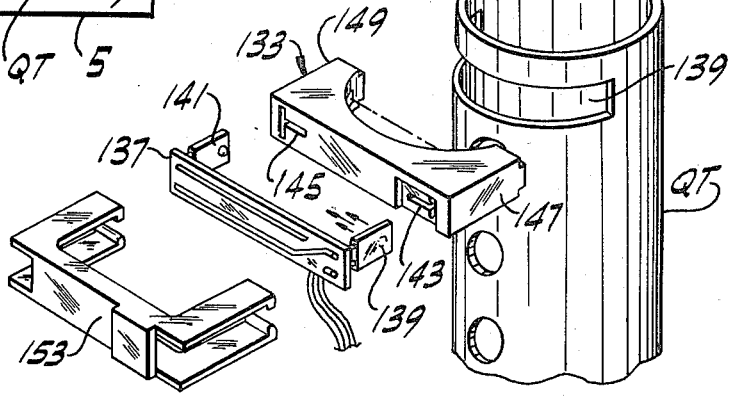

207
+5V
242
ONE SHOT
CP3
123
125
+5V
203
203
+5V
NS
5¢
209
+5V
139
10¢
141
+5V
25¢
$1
DS
203
CP4
123
125
203
+5V
QS
139
DCS
141
201

COIN TESTING AND SORTING APPARATUS

BACKGROUND OF THE INVENTION

This invention relates to coin apparatus, and more particularly to such apparatus for use in a vendor, having an acceptance function for acceptable coins, a rejection function for unacceptable items (slugs or unacceptable coins) and a change-making function, including a self-replenishing change tube feature.

Reference may be made to U.S. Pat. No. 4,106,610 issued Aug. 15, 1978 showing coin apparatus in the same general field of this invention.

SUMMARY OF THE INVENTION

Among the several objects of the invention may be noted the provision of improved coin apparatus of the class described having change tubes for holding stacks of coins of different denominations for making change, adapted to deliver a coin of any one of said denominations inserted in the coin slot of the vendor to the respective change tube as long as the tube is not filled with coins to a predetermined level, adapted to divert coins from the tube to the money box of the vendor when the tube is filled with coins to said predetermined level, and to reject unacceptable items, e.g., slugs and foreign or other unacceptable coins, inserted in the coin slot of the vendor; and the provision of such apparatus which is simplified in operation over the above-noted prior apparatus, while having change tubes for coins of more demoninations.

In general, coin apparatus of this invention comprises a plurality of change tubes, one for each of a plurality of denominations of acceptable coins that may be inserted in the coin slot of a vendor in which the apparatus is used. Each tube has a sensor for sensing the filling of the tube to a predetermined level. A coin sorting means sorts out coins which are to go into the change tubes, having an entrance for coins of the different denominations to be sorted. Means is provided for effecting delivery of coins of each of these denominations inserted in the coin slot of the vendor to the coin sorting means as long as the change tube for coins of that demonination is not filled to the respective predetermined level, for effecting delivery of coins of each of these denominations inserted in the coin slot of the vendor to an accept system of the vendor when the change tube for coins of that denomination is filled with coins to the respective predetermined level, and for effecting delivery of unacceptable items inserted in the coin slot of the vendor to a return system of the vendor. This delivery means comprises guide means movable between a first position for effecting travel of unacceptable items to the return system of the vendor and a second position for effecting travel of acceptable coins to the accept system of the vendor. This guide means normally occupies its first position. Acceptable coins and unacceptable items inserted in the coin slot of the vendor travel through a passage means to said guide means. Along this passage means is means for detecting whether an item travelling therein is an acceptable coin or an unacceptable item, and if it is an acceptable coin, detecting its denomination. Between the detecting means and the guide means is means for exit of coins from passage means to said coin sorting means. This exit means is normally closed. Means is provided which, in response to the sensor of a change tube detecting the level of coins therein as below the respective predetermined level and to the detecting means detecting the passage of a coin of the respective denomination in said passage means, opens said exit means for delivery of the coin to the coin sorting means. Means is also provided which, in response to the sensor of a change tube detecting the level of coins in the tube as above the respective predetermined level and to the detecting means detecting the passage of a coin of the respective denomination in said passage means, moves said guide means to its second position for delivery of the coin to the accept system of the vendor.

Other objects and features will be in part apparent and in part pointed out hereinafter.

BRIEF DESCRIPTION OF THE DRAWINGS

FIG. 8 is a vertical section generally on line 8—8 of FIG. 1;

FIG. 9 is a vertical section generally on line 9—9 of FIG. 1;

FIG. 10 is a horizontal section on line 10—10 of FIG. 8;

FIG. 11 is an exploded perspective showing a coin level sensor system for a change tube;

Corresponding reference characters indicate corresponding parts throughout the several views of the drawings.

DESCRIPTION OF THE PREFERRED EMBODIMENTS

Figures 1, 2:
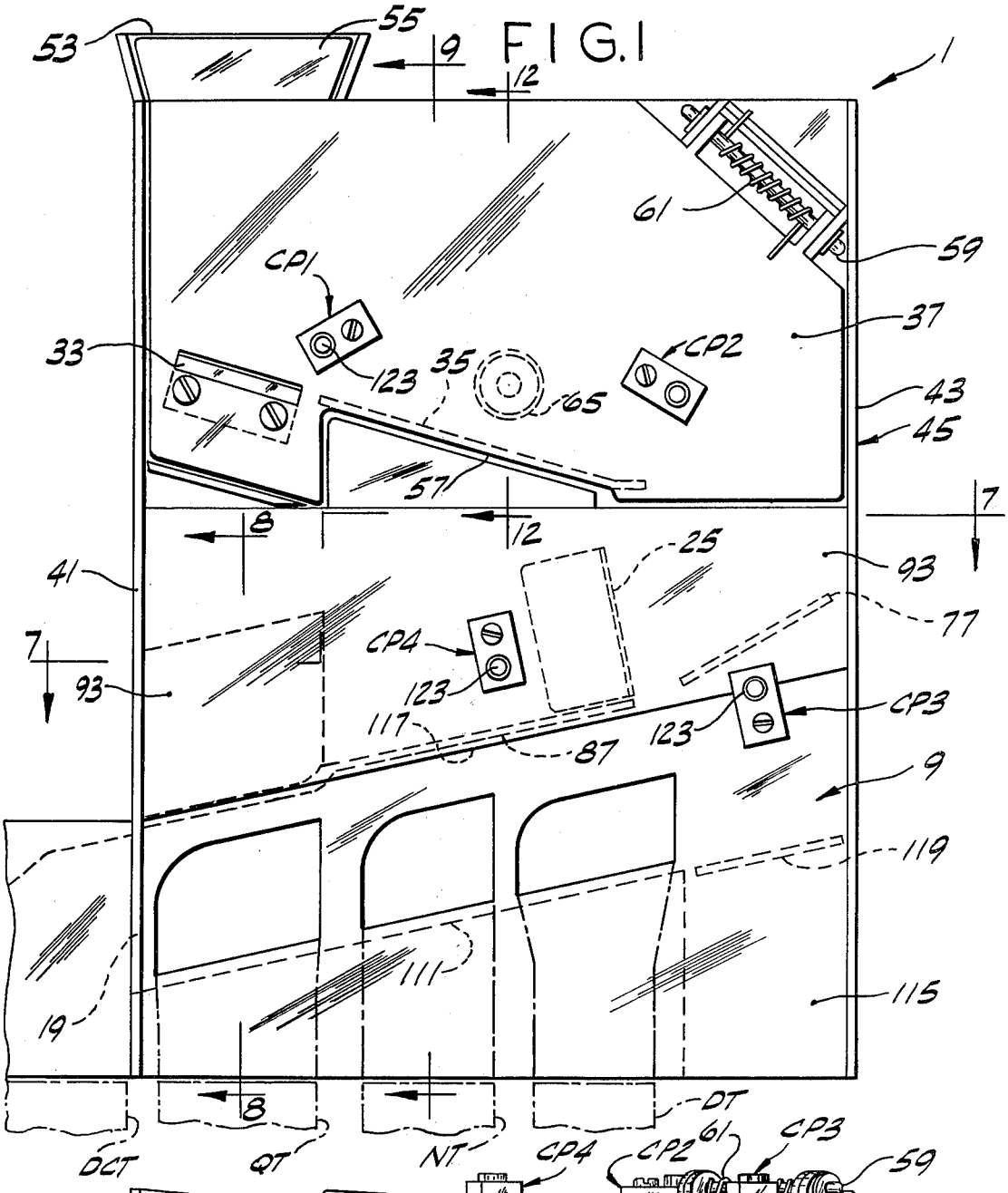
FIG. 1 is a view in front elevation of the upper part of a coin apparatus of this invention, showing in phantom the upper ends of certain change tubes of the apparatus for holding coins to be issued in change.
FIG. 2 is a bottom plan of FIG. 1.
Figure 3:
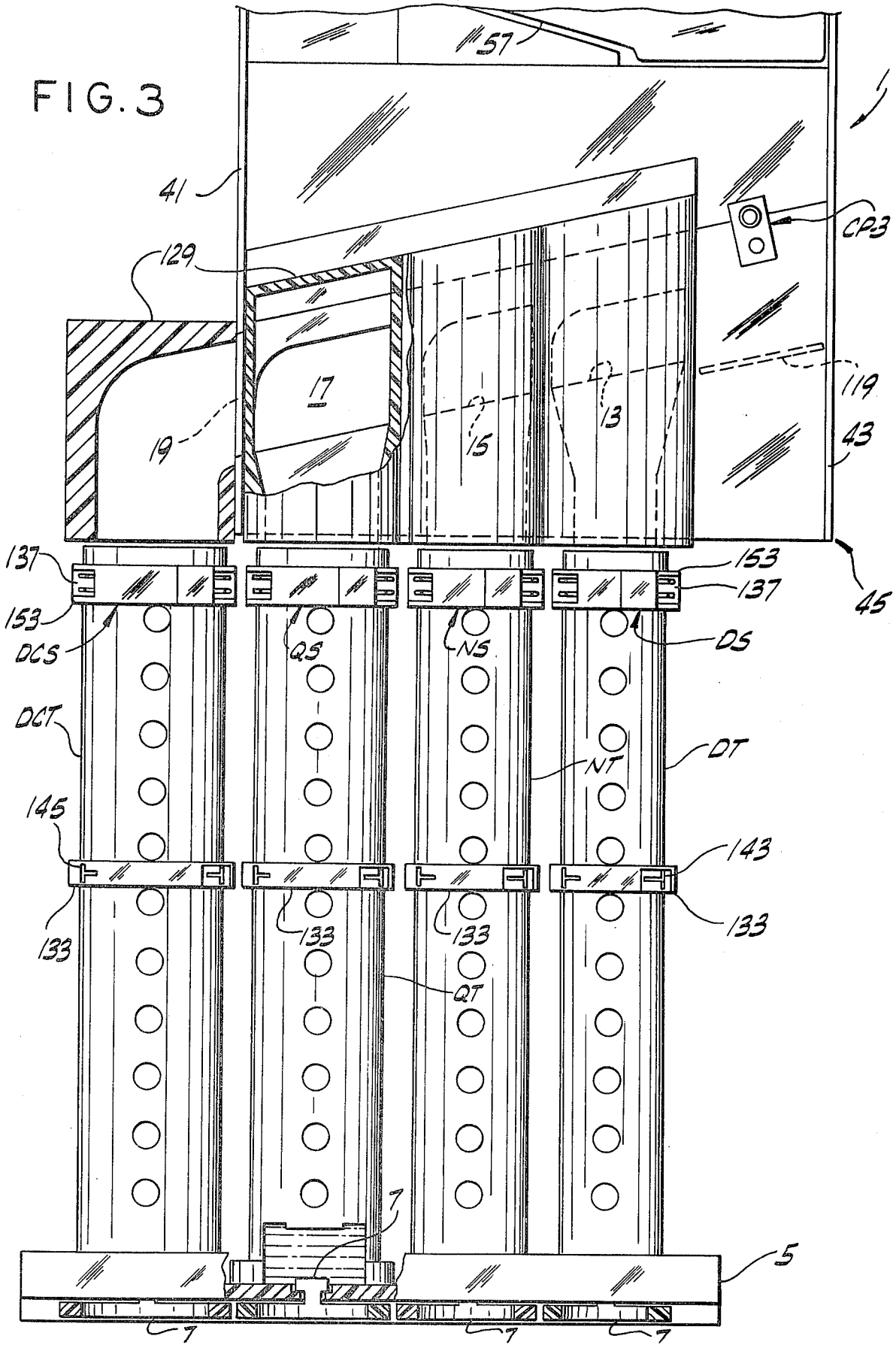
FIG. 3 is a view in front elevation of the lower part of the coin apparatus, showing the change tubes, parts being broken away and shown in section.

Referring to the drawings, first more particularly to FIGS. 1–6, there is generally indicated at 1 coin apparatus of this invention for use in a vendor for handling acceptable coins of a plurality of different denominations and for rejecting unacceptable items, e.g., slugs and unacceptable coins, inserted in the coin slot of the vendor (diagrammed at 2 in FIG. 5), and for making change in a plurality of denominations of coins. As shown in FIGS. 1 and 3, the apparatus has a plurality of change tubes, one for each of a plurality of denominations of acceptable coins that may be inserted in the coin slot of the vendor, each of these tubes being adapted to hold a stack of coins of a respective denomination, and being open at the top for being filled with coins from the top. As herein described, the coin apparatus 1 is adapted to handle U.S. nickels, dimes, quarters and the new U.S. dollar coin, and to make change in nickels, dimes, quarters and dollar coins. Thus, it has a nickel change tube NT, a dime change tube DT, a quarter change tube QT, and a dollar coin change tube DCT. Each of these tubes is a so-called "self-replenishing" tube adapted to hold a stack of coins of the respective denomination and to receive change coins of the respective denomination deposited by purchasers in the coin slot 2 of the vendor until the tube is filled with coins up to a predetermined level. When any tube is filled to its respective predetermined level, any coins of the respective denomination which are then inserted in the coin slot are diverted from entering the tube and delivered to an accept system comprising, for example, the usual money box 3 of the vendor as diagrammed in FIG. 6. The accept system might include an escrow system for escrowing coins and returning them if so elected by the customer.

Coins dropping into each of the change tubes NT (for nickels), DT (for dimes), QT (for quarters) and DCT (for dollar coins) stack up flatwise one on another in the tube, the lowermost coin bearing on a supporting means or base such as indicated at 5 in FIGS. 3, 8 and 10 at the lower end of the tube, and being ejectable from the tube for delivery in change by a suitable ejector such as indicated at 7 in FIGS. 3, 8 and 10, which may be of the type shown in U.S. Pat. No. 3,935,873, for example.

Sensors NS, DS, QS and DCS are provided for sensing the filling of each tube NT, DT, QT and DCT with coins of the respective denominations to a predetermined level. Each of these sensors is positionable at different levels heightwise of the respective tube corresponding to the stacking of different numbers of coins of the respective denomination in the tube for making change, as will be described.

The coin apparatus 1 further comprises coin sorting means indicated generally at 9 for sorting coins of the said different denominations (nickels, dimes, quarters and dollar coins) and delivering to each of the change tubes NT, DT, QT and DCT coins of the denomination for that tube. This sorting means has an entrance at 11 (see FIG. 4) for coins of the different denominations to be sorted and coin-diameter-related exit openings 13, 15 and 17 for dimes, nickels and quarters, respectively, and an end exit 19 for dollar coins at the left end of the coin sorting means 9. Dimes, nickels and quarters drop out laterally through exits 13, 15 and 17 into the respective change tubes; dollar coins roll on edge out of the left end of the coin sorting means and drop into the dollar coin change tube DCT.

Figure 6:
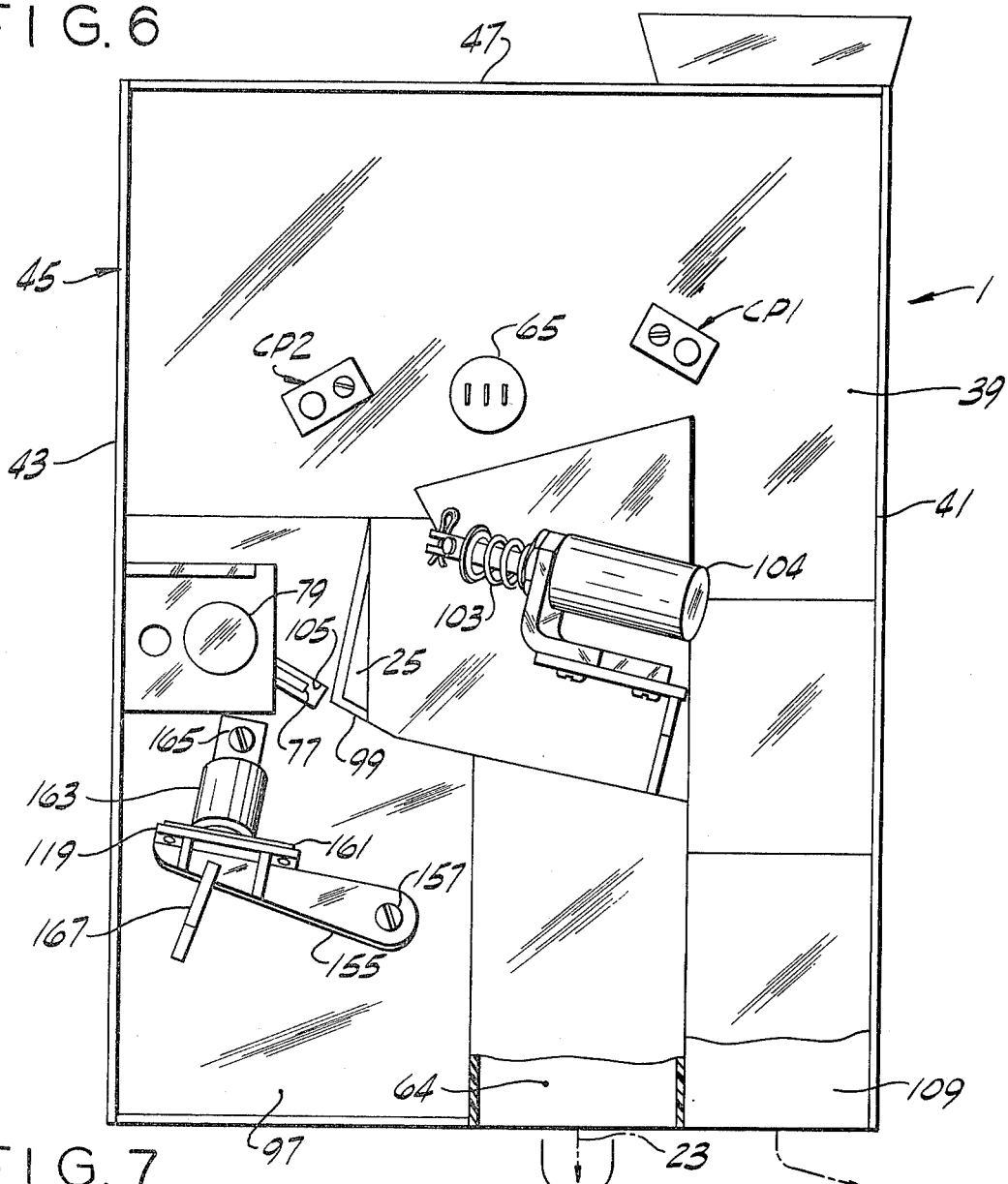
FIG. 6 is a view in rear elevation of the upper part of the coin apparatus.

Above the coin sorting means 9 is means indicated generally at 21 for effecting delivery of coins of each of said denominations inserted in the coin slot 2 of the vendor to the coin sorting means 9 as long as the change tube for coins of that denomination is not filled to the respective predetermined level (as determined by the respective sensor), for effecting delivery of coins of each of said denominations inserted in the coin slot 2 to the accept system comprising money box 3 of the vendor when the change tube for coins of that denomination is filled with coins to the respective predetermined level, and for effecting delivery of unacceptable items (e.g., slugs and unacceptable coins) inserted in the coin slot 2 to the usual return system 23 of the vendor, leading to the usual return cup C, as diagrammed in FIG. 6. Thus, nickels inserted in coin slot 2 are delivered to the coin sorting means 9 for being sorted thereby as long as the nickel tube NT is not filled with nickels to the predetermined level determined by the position of sensor NS, and are delivered to the accept system comprising money box 3 when the nickel tube is filled with nickels to that level. Dimes inserted in coin slot 2 are delivered to the coin sorting means 9 for being sorted thereby as long as the dime tube DT is not filled with dimes to the predetermined level determined by the position of sensor DS, and are delivered to the accept system comprising money box 3 when the dime tube is filled with dimes to that level. Quarters inserted in coin slot 2 are delivered to the coin sorting means 9 for being sorted thereby as long as the quarter tube QT is not filled with quarters to the predetermined level determined by the position of sensor QS, and are delivered to the accept system comprising money box 3 when the quarter tube is filled with quarters to that level. Dollar coins inserted in coin slot 2 are delivered to the coin sorting means 9 for being sorted thereby as long as the dollar coin tube DCT is not filled with dollar coins to the predetermined level determined by the position of sensor DCS, and are delivered to the accept system comprising money box 3 when the dollar coin tube is filled with dollar coins to that level.

The aforesaid means 21 comprises guide means indicated at 25, and more particularly a swingable gate, movable between a first position for effecting travel of unacceptable items to the return system 23 of the vendor for delivery of the unacceptable items to the return cup C of the vendor, and a second position for effecting travel of acceptable coins to the accept system comprising money box 3 of the vendor. The gate 25, which may be referred to as the accept/return gate, normally occupies its stated first position (which is its return position) as shown in solid lines in FIG. 7, and is movable to its second or coin acceptance position (indicated in dotted lines in FIG. 7) in response to an acceptance signal as will appear.

Figure 4:
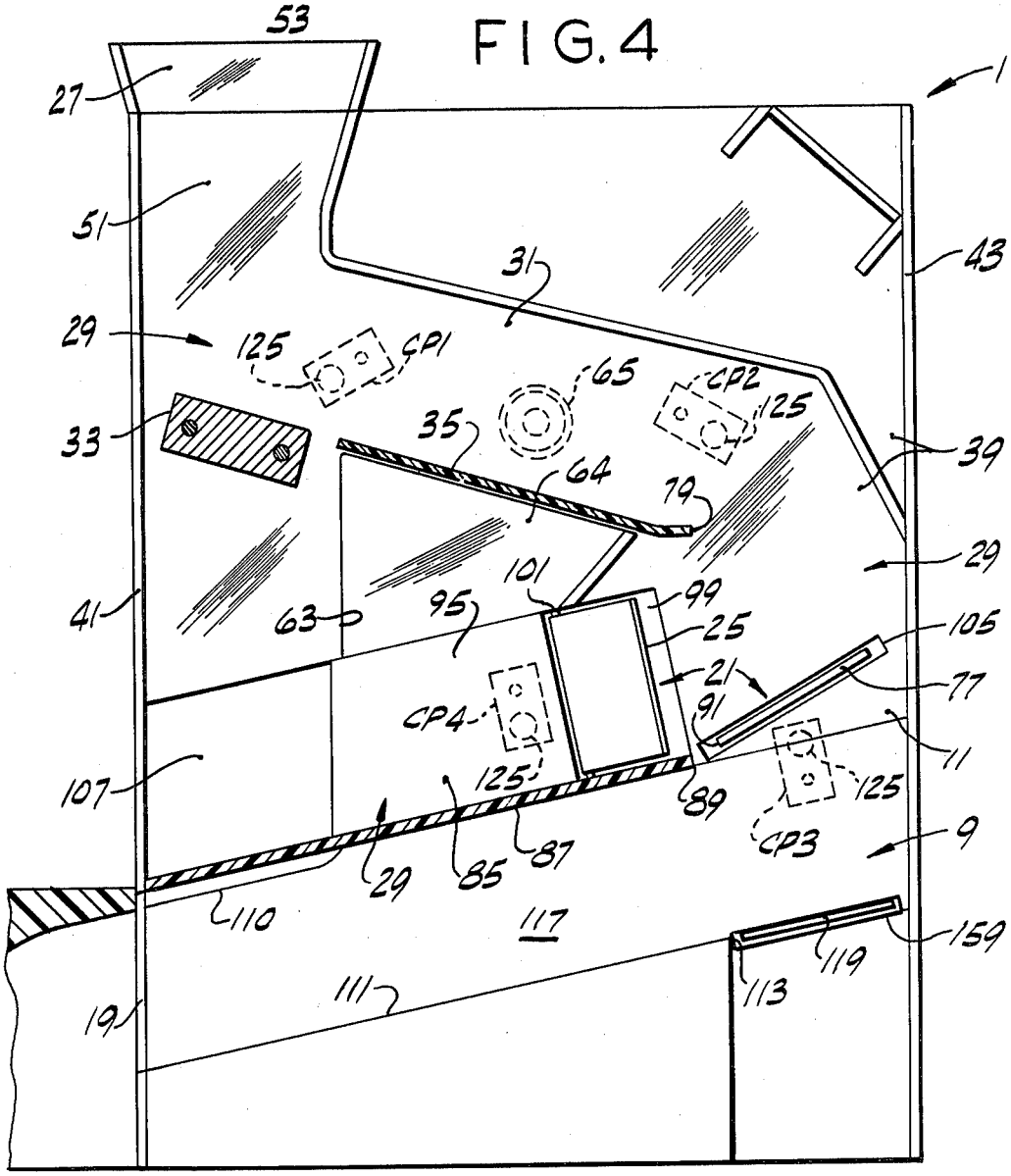
FIG. 4 is a view similar to FIG. 1 with parts removed to show interior detail and parts shown in section.
Figure 5:
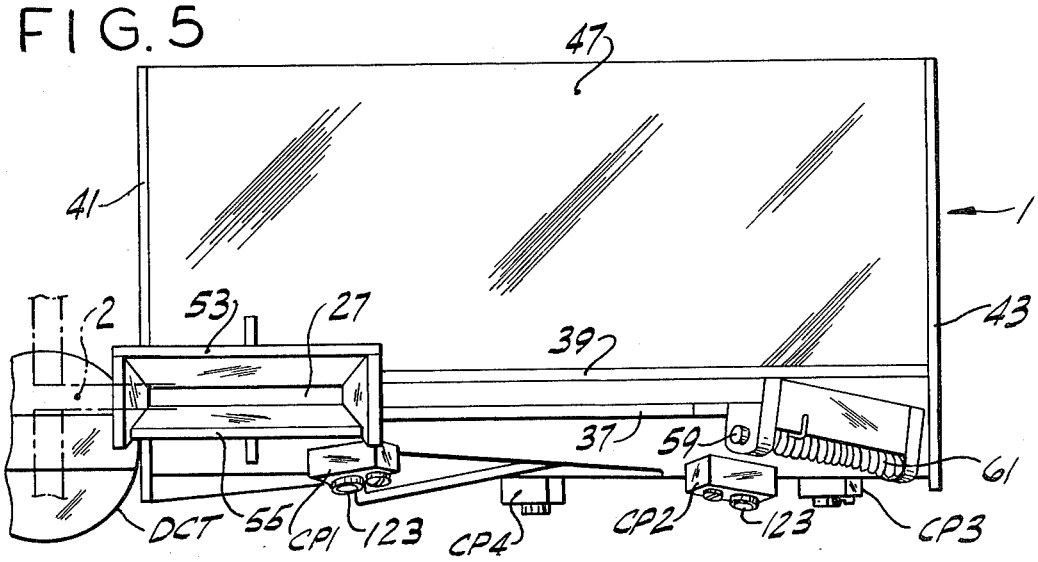
FIG. 5 is a top plan view of the coin apparatus.

Acceptable coins and unacceptable items inserted in the coin slot 2 of the vendor drop through a slot 27 at the top of the coin apparatus 1 into a passage means generally designated 29, and are adapted to travel through this passage means to the guide means or gate 25 (see particularly FIG. 4). With regard to the apparatus as herein disclosed, acceptable coins are U.S. nickels, dimes, quarters and the new U.S. dollar coin, which is of somewhat larger diameter than a quarter. Unacceptable items are other U.S. coins (although the apparatus may be modified to accept U.S. half dollars and such new U.S. coins as may be introduced), foreign coins (although it may be modified to accept some foreign coins, such as Canadian coins for some areas of the country), and slugs.

Figure 12:
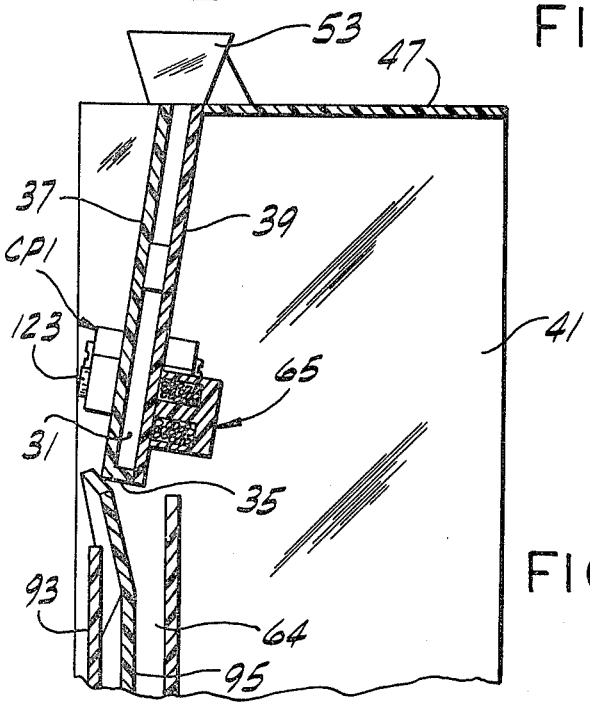
FIG. 12 is a vertical section generally on line 12—12 of FIG. 1.

Acceptable coins and unacceptable items, after dropping down in the slot 27, roll down on edge in the passage means 29 through a first reach 31 of the passage means, constituting an upper inclined reach of the latter. This reach of the passage means is formed by rail members 33 and 35, inclined down from the left side of the apparatus toward the right side of the apparatus as viewed from the front, on which coins and other circular members may roll on edge, and front and rear panels 37 and 39 (see particularly FIGS. 9 and 12) forming in conjunction with the rail members 33 and 35 an inclined chute in which coins and other items are confined for rolling down from left to right. The rear panel 39 is fixed in position extending between left and right side walls 41 or 43 of a housing 45, lying in a plane which is inclined as appears in FIGS. 9 and 12 in the direction toward the front of the apparatus from top to bottom, so that items roll down on the rail members 33 and 35 in face-to-face engagement with the rear panel 39. The housing 45 has a top 47 and a bottom 49. The rail member 33 comprises a short strip of metal secured to the front panel 37 at the lower end of a vertical reach 51 of the passage means 29 in line with the entrance slot 27. The latter is defined by a three-sided formation 53 (see particularly FIG. 5) at the top left of the rear panel 39 and a tongue 55 at the top left of the front panel 37. The rail member 35 is formed by a rearwardly extending flange on an inclined lower edge portion 57 of the front panel 37. The latter is pivoted as indicated at 59 at its upper right corner for swinging movement toward and away from the rear panel 39 and is biased by a spring 61 to a closed position wherein the rail members 33 and 35 engage the rear panel, in which closed position the panels lie generally parallel to one another spaced the width of the rail members. This spacing is slightly greater than the thickness of the thickest coin to be handled, so that the coins may roll down on the rail members 33 and 35 confined between the panels and leaning back on the rear panel 39. The front panel 37 is adapted to be swung away from the rear panel 39 to removed the bottom support of rail member or flange 35 for a coin or other item which may have become jammed in reach 31 of the passage means 27 to clear the jam (i.e., for scavenging), the coin or other item then sliding off the rear panel 39 and exiting via an exit opening 63 in the rear panel 39 and passing via a chute 64 to the return system 23 of the vendor (see FIGS. 4, 6, 7 and 9).

Means indicated generally at 65 (see FIGS. 1, 4 and 12) is provided along the upper inclined reach or chute 31 of the passage means 29 for detecting whether an item travelling therein is an acceptable coin or an unacceptable item and, if it is an acceptable coin, detecting its denomination. This detecting means 65 may be an electromagnetic detector or inductor such as shown in U.S. Pat. Nos. 3,918,564, 3,952,851 or 3,966,034, for example, adapted on passage thereby of an item in chute 31 to transmit a signal indicative of the item being an unacceptable item or an acceptable coin and, if an unacceptable coin, indicative of its denomination. The detecting means is mounted on the rear panel 39 of chute 31 (see particularly FIG. 12) and an item rolling down the chute leans back on panel 39 as it passes the detecting means so that each item rolls past it in the same plane for consistent detection.

Figure 7:
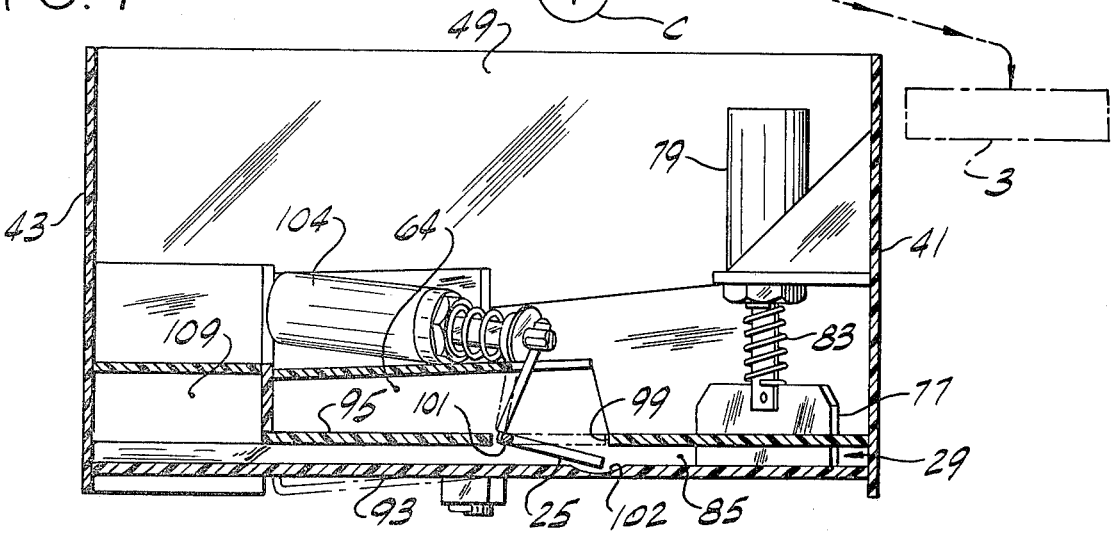
FIG. 7 is a view in section generally on line 7—7 of FIG. 1.

Means comprising a gate 77 is provided between the detecting means 65 and the accept/return gate 25 for exit of coins from the passage means 29 to the coin sorting means 9. This exit gate is located at the right of the apparatus in position above the entrance 11 of the coin sorting means 9 and below and to the right of the downstream end 79 (the right end) of the rail or flange 35. It is movable by a solenoid 79 (see FIGS. 6 and 7) between a closed position wherein it forms a bottom for the passage means 29 (as illustrated in FIG. 7) and an open position for fall of coins rolling over the right end 79 of rail 35 down into the entrance 11 of the coin sorting means. The exit gate 77, which is inclined downwardly from right to left (see FIG. 4), is normally closed, being biased to closed position by a spring 83 and opened by the solenoid on energization of the solenoid. The passage means 29 has a second reach or chute 85 below the first reach or chute 31 inclined downwardly toward the left side of the apparatus away from the exit gate 77. This reach or chute 85 is bottomed by a rail 87 inclined downwardly from right to left having its upstream end 89 adjacent the left (downstream) edge 91 of the exit gate 77, for ongoing rolling of items down toward the left off the exit gate when the exit gate is closed, the items rolling down to the guide means or gate 25. A generally vertical front panel 93 and a generally vertical upper portion 95 of an inclined rear panel 97 (see FIG. 9) form in conjunction with the rail 87 chute 85 inclined downwardly from right to left, in which coins are confined for rolling down from right to left. The vertical portion 95 of the stated rear panel 97 has an opening 99 for the gate 25, which is pivoted as indicated at 101 in FIG. 7 at its left side (its downstream side) for swinging movement between its stated first and second positions. In its first position (solid lines in FIG. 7), gate 25 extends at an angle across the chute 85 with its right or upstream edge received in a groove 102 in the panel 93, whereby items roll off the exit gate 77 into the chute 85 through the opening 99 to the rear of vertical portion 95 of the panel 97. Thus, under these circumstances, opening 99 forms a rear outlet for the reach or chute 85. Items exiting from chute 85 through the opening 99 drop through the aforesaid chute 64, which is formed on the back of rear panel 97 and its upper portion 95, and drop out of the lower end of this return chute into the return system 23 of the vendor for return to the customer. The gate 25 is biased by a spring 103 (see FIGS. 6 and 7) to its stated first position (solid lines in FIG. 7) and is movable to its stated second position by a solenoid 104 on energization of the latter. The exit gate 77 is movable forward and rearward through a slot 105 in the vertical portion 95 of the inclined panel 97, being moved forward to its closed position of FIG. 7 by spring 83 and rearward to its open position by solenoid 79.

The gate 25 is swingable by the solenoid 104 from its stated first position which may be referred to as its return position, (solid lines in FIG. 7) to its second position, which may be referred to as its accept position, for directing acceptable coins to the accept system comprising money box 3 of the vendor, its second position (shown in phantom in FIG. 7) being a position wherein it lies within the outlet opening 99 generally in the plane of the vertical portion 95 of the panel 97, in which the chute 85 is unobstructed for passage of a coin from right to left to the lower end of the chute. Here the coin exits to the rear through an exit opening 107 and drops through a chute 109 formed on the back of the panel 97 for delivery to the accept system comprising money box 3 of the vendor. The coin is made to lean back for exiting through opening 107 by a skewed portion 110 of rail 87.

The coin sorting means 9 comprises a fixed track or rail 111 on the front of the rear panel 97 (which is inclined toward the rear from top to bottom), this rail 111 extending on an incline down from right to left from a point 113 spaced from the right side wall 43 of the housing 45 all the way to the left side wall 41 of the housing.

The rear panel 97 extends all the way from side wall 43 to side wall 41. In conjunction with the rear panel 97 and a front panel 115 in a plane generally parallel to the rear panel 97 and in front of the rear panel 97, the rail 111 forms a coin sorting passage or chute 117 extending below the reach 85 (chute 85) of the passage 29, and inclined downwardly from right to left. Coins may roll on edge down this chute 117, after entering the coin sorter 9 at 11. A coin dropping down into the coin sorter 9 through its entrance 11 strikes a member 119 which extends generally in line with the rail 111 between the upper end 113 of the rail and the right side wall 43 of the housing and which is adapted to dampen the fall of the coin so that the coin proceeds on from the member 119 without undue bounce down the coin sorting chute 117 for being according to its denomination.

The dime, nickel and quarter exits 13, 15, 17 are openings in the front panel 115, the dime opening 13 being the first opening along the chute 115 and dimensioned for drop-out of dimes but not any larger-diameter coin, the nickel opening 15 being next and dimensioned for drop-out of nickels but not any larger-diameter coin, and the quarter opening 17 being last and dimensioned for drop-out of quarters but not any larger-diameter coin. Thus, nickels, dimes and quarters rolling down in the chute 117, and leaning forward on the inclined front panel 115 of this chute, drop out on reaching the appropriate exit opening and fall into the appropriate change tube NT, DT, QT. A dollar coin rolls down the chute 117 without dropping out of any of the exit openings 13, 15, 17, and exits through the opening 19 at the left end of the coin sorting means 9 in the left side wall 41 of the housing 45 and drops into the dollar change tube DCT.

A first sensor means CP1 is provided upstream from the detecting means 65 for sensing the passage of an item through the upper reach or chute 31 of the passage means 29 to the detecting means 65, and a second sensor means CP2 is provided downstream from the detecting means 65 (between the latter and the gate 77) for sensing the passage in chute 31 of an item from the detecting means toward the gate 77. A third sensor means CP3 is provided at the entrance 11 of the coin sorting means 9 for sensing the fall of a coin through the entrance 11 to the coin sorting means (gate 77 opening for this purpose). A fourth sensor means CP4 is provided for sensing the passage of an accepted coin in chute 85 downstream from the accept/return gate 25. Each of these four sensor means CP1–CP4 comprises a light emitting diode (LED) as indicated at 123 mounted on one side of the respective chute or passage for directing a beam of light across the respective chute or passage, and a phototransistor as indicated at 125 mounted on the other side of the respective chute or passage in position to receive the beam, the arrangement being such that the beam is cut off from reaching the phototransistor when an item passes between the LED and the phototransistor. For example, the LED 123 of sensor means CP2 is mounted on panel 37 and the phototransistor 125 of this sensor means is mounted on panel 39 opposite the LED, the LED and phototransistor being on opposite sides of the path of an item rolling down the chute 31. The first sensor CP1 is shown since it may be used in conjunction with the second sensor CP2 to effect return of coins if they roll down chute 31 too close to one another; the detail of the circuitry for this is not shown since it does not constitute part of this invention.

Each of the change tubes NT, DT, QT and DCT, which may be molded of suitable plastic, has an annular wall with an internal circular circumference on a diameter slightly larger than the diameter of coins of the respective denomination to be stacked in the tube. Each tube is open at its upper end for loading it with coins, and has its upper end so positioned in relation to the respective exit 13, 15, 17, 19 of the coin sorter 9 that a coin dropping out of an exit drops into the respective tube through the open upper end of the tube. Dollar coins drop down generally on edge; nickels, dimes and quarters tip over on exiting from the coin sorter 9 through the respective drop-out opening. A hood such as indicated at 129 in FIGS. 3 and 8 may be provided around the sorter exits, this hood being open at the bottom. The change tubes at their lower ends are fitted in recesses in the respective bases 5, each tube being open at its lower end and the stack of coins in the tube being supported on the base, which has a slot 131 for the ejector 7.

Figure 13:
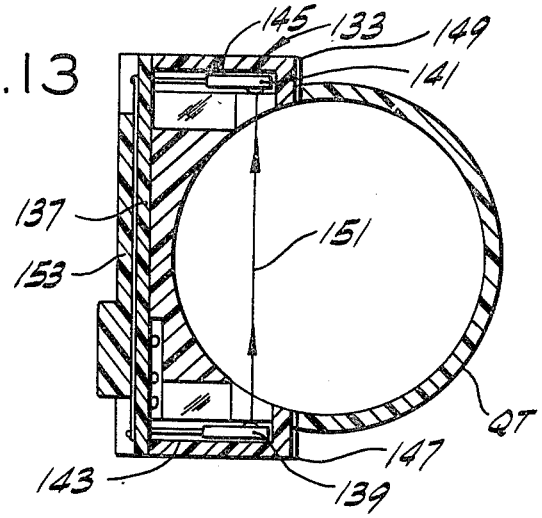
FIG. 13 is an enlarged horizontal section on line 13—13 of FIG. 8.

As above noted, each change tube made be made to enable mounting the respective sensor NS, DS, QS, DCS at different levels corresponding to the stacking of different numbers of coins of the respective denomination in the tube. Thus, each tube at different levels has a sensor mount 133 secured in suitable manner on the outside of the tube at a transverse slot 135 in the tube wall. Each sensor NS, DS, QS, DCS comprises a strip 137 of insulation material having a light emitting diode (LED) 139 extending at right angles to the strip from one face of the strip adjacent one end of the strip adapted to emit a beam of light in the direction toward the other end of the strip and generally parallel to the strip, and a phototransistor 141 extending at right angles to the strip from said face of the strip adjacent the other end of the strip adapted to receive the beam (if uninterrupted). The LED 139 and phototransistor 141 are plugged into sockets 143 and 145 in the sensor mount 133 adjacent the ends 147 and 149 of the sensor mount, these sockets being laterally open at their inner ends for transmission (via the slot 135) of the beam of light from the LED 139 to the phototransistor 141 across a chord 151 (see FIG. 13) of the circle defined by the inner circumference of the tube. The sensor mount 133 is so formed, as shown in FIG. 13, that the LED 139 and the phototransistor 141 lie outside the circle defined by the internal circumference of the tube at the ends of said chord. A clip member for securing the sensor (the LED, phototransistor and strip assembly) in place plugged into member 133 is indicated at 153. The arrangement is such that as long as the stack of coins in a tube is below the level of the sensor for that tube, the beam of light from the LED to the phototransistor is uninterrupted. When the tube is filled to the level of the sensor the coin at the top of the stack blocks the beam, and the sensor transmits a signal indicative of the change tube being filled with coins to the level of the sensor.

Figure 14:
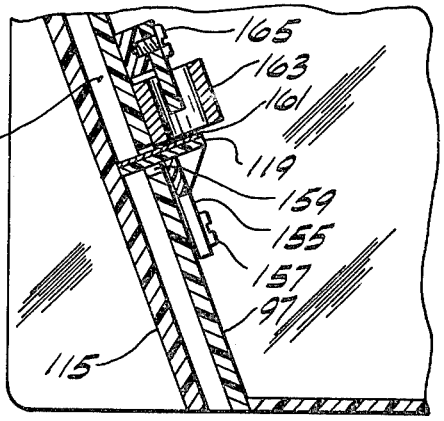
FIG. 14 is a section generally on line 14—14 of FIG. 6.

As best shown in FIGS. 6 and 14, the member 119 at the bottom of the coin sorter chute 85 at its upper right end comprises a plate constituted by a flange on the upper edge of an arm 155 pivoted at 157 on the back of panel 97. This plate extends through a slot 159 in the panel 97 and forms a bottom for the chute 85 between the upper end 113 of rail 111 and the right side wall 43 of housing 45. The plate is magnetically attractable, made so, for example, by being provided with a facing 161 of ferromagnetic material, e.g., iron. The plate is attracted upwardly by a magnet 163 mounted as indicated at 165 on the back of panel 97, and is adapted to move downwardly a limited distance as determined by engagement of the arm 155 with a stop 167. The arrangement is such that most of the kinetic energy of a coin falling into the coin sorting means 9 through its entrance 11 and striking the member 119 is taken up in overcoming the magnetic attraction of member 119 to the magnet 163. The member 119 moves down a small amount (controlled by the location of stop 167) and the force of attraction falls off at a rate equal to the square of the change in distance between the magnet and the facing 161. Magnet 163 is illustrated as a permanent magnet; it may be an electromagnet and it is contemplated in the latter case that its energization may be varied to vary its field strength for optimum dampening of coins of different mass.

Figure 16:
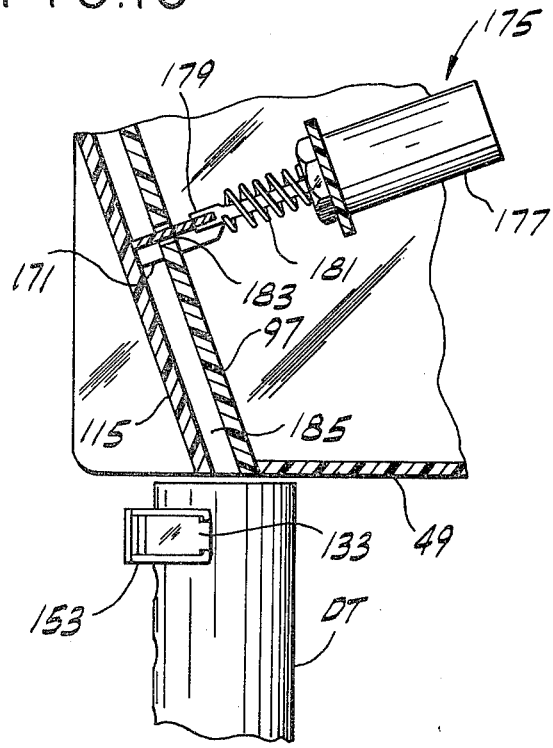
FIG. 16 is a vertical section generally on line 16—16 of FIG. 15.
Figure 17:
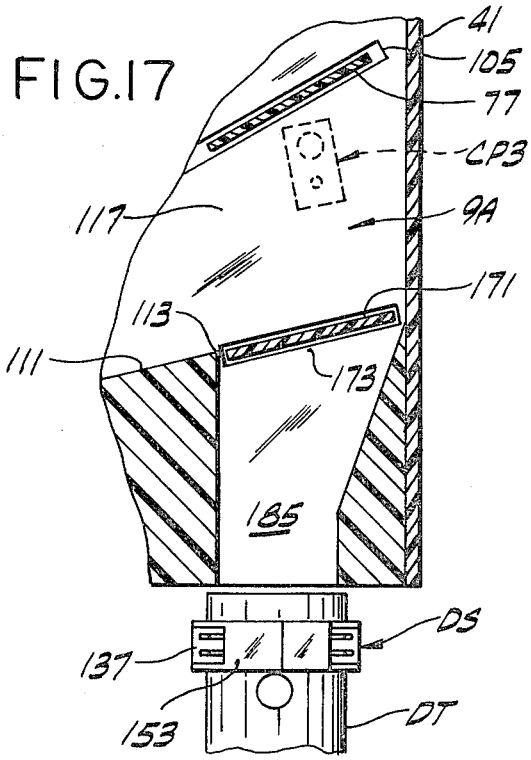
FIG. 17 is a view of the lower right portion of FIG. 15 with parts broken away to show interior detail and parts shown in section.
Figure 15:
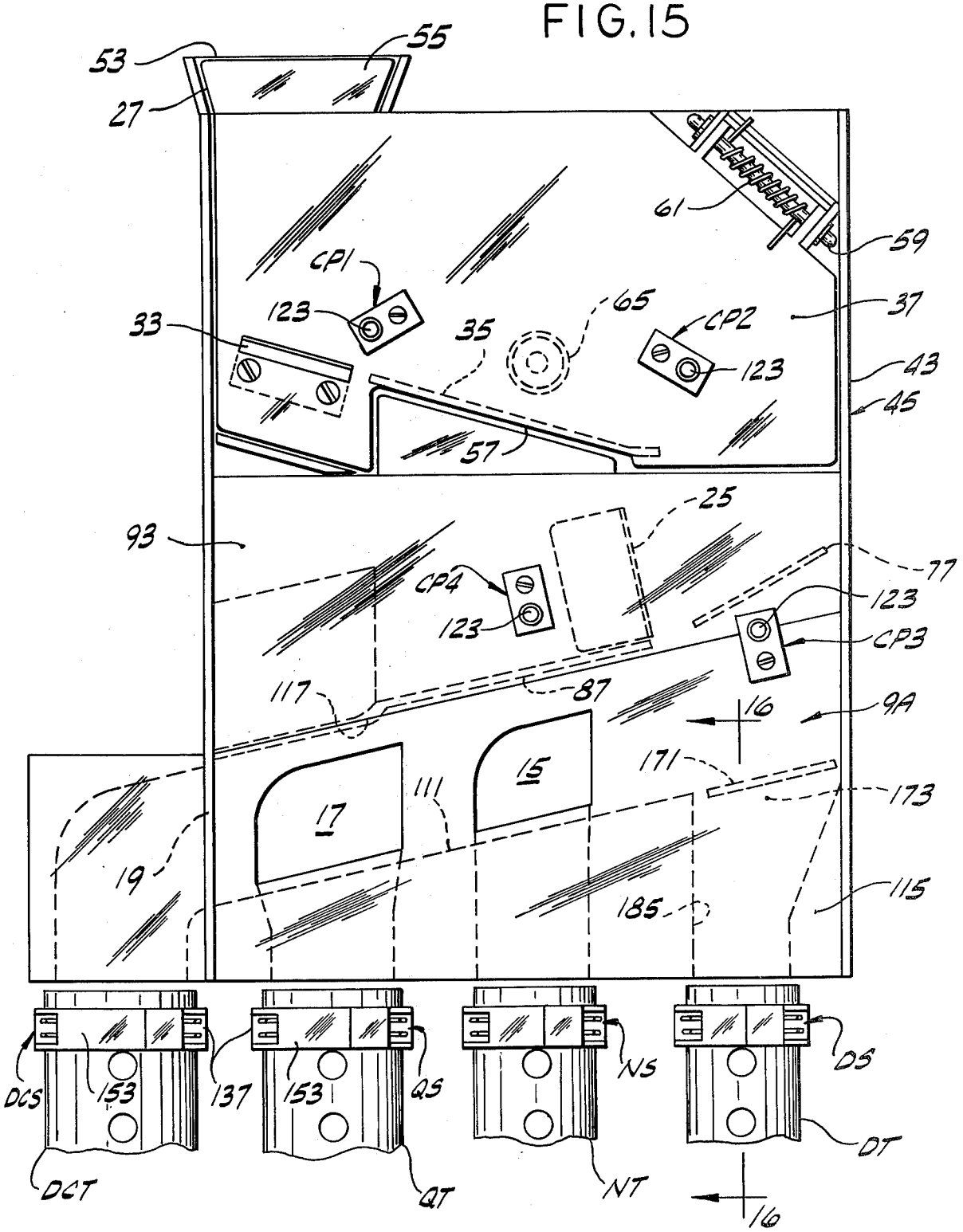
FIG. 15 is a view similar to FIG. 1 showing a second embodiment of the invention.

FIGS. 15–17 illustrate a second embodiment of the invention wherein the coin sorting means is modified to sort out coins of one denomination from the others by means of a sorting gate at the bottom of the coin sorting passage or chute 117. The modified coin sorting means is generally designated 9A. It comprises a coin sorting chute 117 as in the previously described coin sorting means 9, but the member 119 which stops the fall of coins into the coin sorting means is replaced by the sorting gate, which is designated 171. This gate normally closes a bottom exit 173 for the coin sorting means, this exit being the opening (like a slot) at the bottom of chute 117 between the upper end 113 of the rail 111 and the right side wall 43 of housing 45. Means indicated generally at 175 is provided for opening the gate 171 for drop-out of coins from the coin sorting chute 117 into the respective change tube.

As herein illustrated, dimes are sorted out via drop-out through the bottom exit 173 and drop into the dime change tube DT. The exit 173 and sorting gate 171 are under the exit gate 177 at the upstream (upper) end of the coin sorting passage or chute 117. Nickels and quarters are sorted out downstream from the exit 173 and gate 171 via coin-diameter-related exit openings 15 and 17, the same as in the first embodiment of the invention, and dollar coins roll on down and out of the dollar coin exit opening 19 and drop into the dollar coin change tube, the same as in the first embodiment. There is no opening 13 in the second embodiment.

The gate 171 is constituted by a plate (similar to gate 77). Means 175 comprises a solenoid 177 mounted in back of panel 97 having its plunger 179 extending forward. Gate 171 is mounted on the forward end of the plunger inclined downwardly from right to left. A spring 181 biases the plunger and the gate 171 forward to the closed position of the gate wherein it extends through a slot 183 in panel 97 and engages the panel 115. On energization of the solenoid, the gate 171 is drawn back through the slot 183 to open up the exit 173 before a dime dropping down in the chute 117 at its upper end strikes the gate 171, for drop-out of the dime from the chute 117. The dime dropping out of chute 117 drops down through a chute 185 formed between the panels 115 and 97 at the right which guides the dime into the dime tube DT.

Figure 18A:
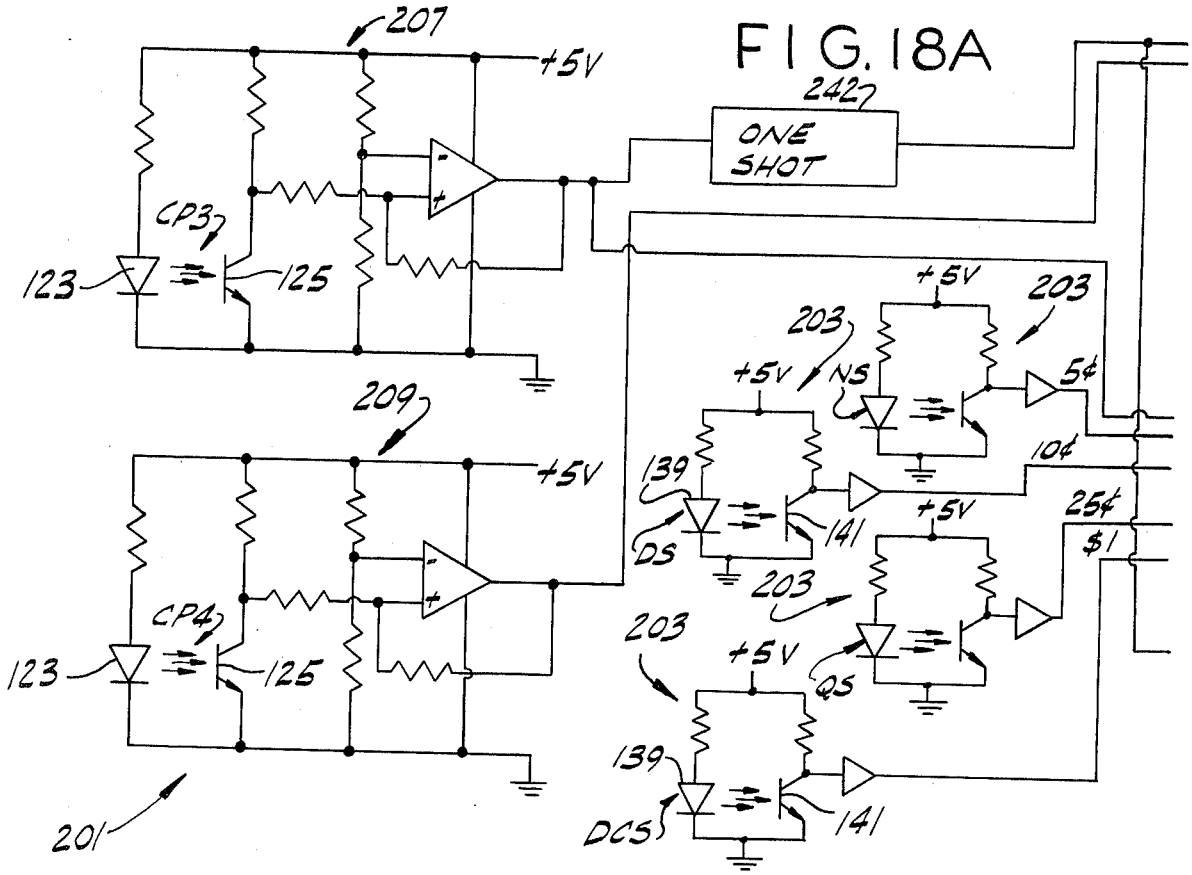
FIGS. 18A and 18B together constitute a diagram of an electrical circuit for the apparatus of FIGS. 1–13 and the apparatus of FIGS. 15–17.
Figure 18B:
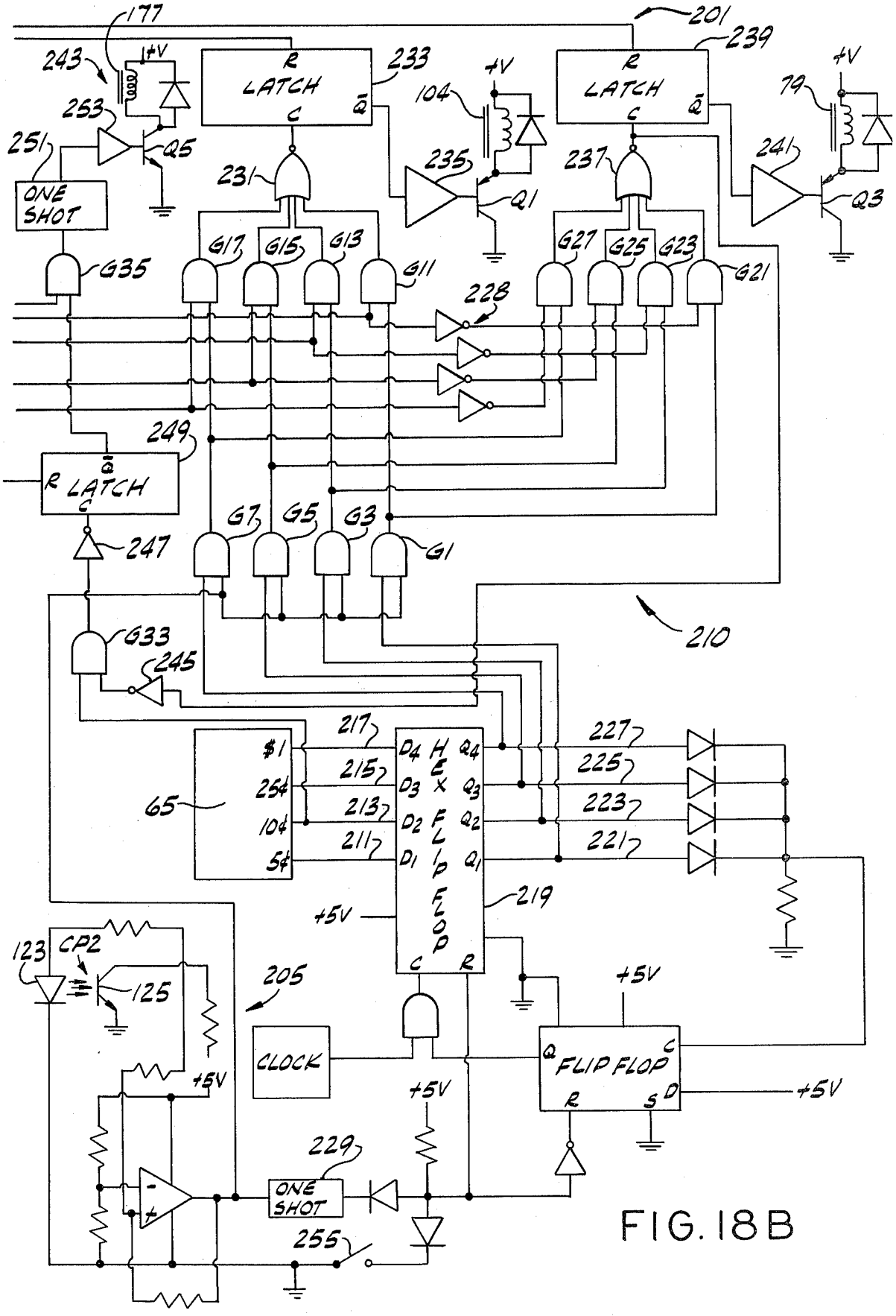

Circuitry for controlling the operation of either embodiment of the apparatus is indicated generally at 201 in FIGS. 18A and 18B. This includes four LED-phototransistor sensing circuits 203, one for each of the four sensors DS, NS, QS and DCS for the four change tubes DT, NT, QT, DCT for sensing if the respective change tube is filled to the level determined by the sensor DS, NS, QS, DCS for the tube; the LED-phototransistor sensors CP2, CP3 and CP4 for sensing the passage of coins at their respective positions; wave shaping circuits 205, 207 and 209 for shaping the signals from sensors CP2, CP3 and CP4 respectively; detector 65 for detecting valid nickels, dimes quarters and dollar coins and for supplying signals corresponding to the particular coin detected to the circuit 201; logic circuitry indicated generally at 210; and the coils of gate-actuating solenoids 79, 104 and 177.

As a coin or other item travels down chute 31 (inclined down from left to right), it first passes the detector 65, which may comprise an electromagnetic sensor and associated decoding circuitry such as shown in U.S. patents 3,918,564, 3,952,851 or 3,966,034 as above noted. Detector 65 has four output lines 211, 213, 215 and 217 corresponding to nickels, dimes, quarters and dollar coins respectively. If the coin or other item is not a nickel, dime, quarter or dollar coin, the lines 211, 213, 215 and 217 stay Low (i.e., at zero volts), indicating that no acceptable coin has been detected. Circuitry 201 is only responsive to High (e.g., 5 volt) voltage levels on lines 211, 213, 215 and 217; thus the passage of an unacceptable item past detector 65 does not affect circuitry 201. Accordingly, none of the gate-actuating solenoids are energized when an unacceptable item is deposited in the vendor. The gates, therefore, all remain in their normal positions while an unacceptable item passes through the apparatus, thereby directing the unacceptable item to the system 23 of the vendor and thence to the return cup C.

If the item passing the detector 65 is a valid nickel, dime, quarter or dollar coin, on the other hand, the detector causes the respective output line to go High. The output lines of the detector are connected to a flip-flop 219 which functions as a latch to preserve the coin identification information for subsequent use by logic circuitry 210. Flip-flop 219 has four outputs 221, 223, 225 and 227 corresponding to nickels, dimes, quarters and dollar coins respectively. When line 211 from the detector 65 goes High, indicating a valid nickel, output line 221 of flip-flop 219 goes High in response. Likewise lines 223, 225 and 227 go High in response to Highs on lines 213, 215, 217, respectively. The output lines of flip-flop 219 are connected to a set of four AND gates G1, G3, G5 and G7, line 221 being connected to AND gate G1, line 223 to AND gate G3, line 225 to AND gate G5 and line 227 to AND gate G7. The outputs of these gates are in turn connected to second set of four AND gates G11, G13, G15 and G17 and a third set of four AND gates G21, G23, G25 and G27, AND gate G1 being connected to AND gates G11 and G21, AND gate G3 to AND gates G13 and G23, AND gate G5 to AND gates G15 and G25, and AND gate G7 to AND gates G17 and G27.

The other input of each of the AND gates in the second and third sets is a signal indicating the status of the change tube for the coin of the denomination corresponding to that AND gate. AND gate G11, for example, receives a Low signal from the nickel change tube sensing circuit when the tube is not filled to the respective predetermined level, and a High when it is so filled. Likewise, AND gate G13 is supplied a High when the dime tube is filled to the respective predetermined level, AND gate G15 is supplied a High when the quarter tube is filled to the respective predetermined level, and AND gate G17 is supplied a High when the dollar coin tube is filled to the respective predetermined level. Thus, the only AND gates of the second set that are enabled are those corresponding to a fully replenished change tube. The signals supplied to AND gates G11, G13, G15 and G17 are also supplied to a set of inverters 228 which invert the signals and supply them to AND gates G21, G23, G25 and G27, respectively. Consequently, the only AND gates of the third set that are enabled are those corresponding to change tubes needing replenishing.

After an acceptable coin passes the detector 65 a signal (a High voltage level) representing that coin is supplied from flip-flop 219 to an input of one AND gate of the first set. For example, if the coin is a quarter, one input to AND gate G5 will be High and the corresponding inputs to AND gates G1, G3, and G7 will be Low. As the coin continues along its path it is next sensed by sensor CP2, which causes the output of wave shaping circuit 205 to be a positive pulse corresponding in width to the time the coin takes to pass the sensor. This positive pulse is supplied to a one-shot 229 and to the other inputs of AND gates G1, G3, G5 and G7, thereby enabling those gates. The output of the AND gate corresponding to the denomination of the coin deposited in the vendor (in this example AND gate G5, since the coin is a quarter) thereupon goes High substantially for the duration of the pulse from circuit 205. This High is supplied to the AND gates corresponding to that denomination coin in the second and third sets of AND gates (in this case AND gates G15 and G25). If the change tube corresponding to that denomination coin is filled to the respective predetermined level, the output of the appropriate AND gate in the second set thereupon goes High, while if that change tube is not filled to the requisite level the output of the appropriate AND gate in the third set will go High instead.

For example, if the quarter change tube is filled to the requisite level and a quarter coin has been deposited, the output of AND gate G15 goes High when it is supplied a High from gate G5. This High is supplied to a NOR gate 231 whose output is connected to the clock input of a latch 233. The $\overline{Q}$ output of latch 233 thereupon goes Low and this Low is supplied via a buffer 235 to the base of a PNP transistor Q1 which is in the grounded-collector mode, causing it to conduct. The emitter of transistor Q1 is connected to the coil of gate-actuating solenoid 104, so when transistor Q1 conducts, that solenoid is actuated, causing gate 25 to be swung to its accept position (shown in phantom in FIG. 7) to permit the coin to pass into the money box.

On the other hand, if the quarter tube is not filled to the requisite level the output of NOR gate 231 will stay High, transistor Q1 will not conduct and gate 25 will remain in its normal position (as shown in solid lines in FIG. 7). In this situation, the quarter is needed in the quarter change tube QT, so the circuitry causes gate 77 to open rather than gate 25. This is accomplished by circuitry substantially identical to that used to actuate solenoid 104. Specifically the outputs of the third set of AND gates are supplied to a NOR gate 237 which is connected to the clock input of a latch 239. The Q output of latch 239 is connected through a buffer 241 to the base of a PNP transistor Q3, which energizes the coil of gate-actuating solenoid 79 when it conducts. In the present example, the High output of gate G25, corresponding to the detection of a valid quarter and a quarter change tube that is not filled to the requisite level, causes the output of NOR gate 237 to go Low, the Q output of latch 239 to go Low and transistor Q3 to conduct, thereby energizing the coil of solenoid 79 and causing the gate 77 to open. As a result the quarter, or in general any valid coin needed in the change tubes, is allowed to fall past gate 77 into the coin sorting means 9 through the entrance 11 of the latter.

Once the $\overline{Q}$ output of latch 233 or 239 has been set, the coin information from flip-flop 219 is no longer needed. Accordingly, near the end of the pulse from wave shaping circuit 205, one-shot 229 supplies a short, Low pulse to the reset input of flip-flop 219, thereby clearing it.

After a valid coin has passed gate 77 or gate 25, depending upon whether or not that coin is needed in the respective change tube, the gate which was actuated must be returned to its normal position. This is accomplished by means of sensor CP3 and circuit 207 in the case of the exit gate 77 and by means of sensor CP4 and circuit 209 in the case of the accept/return gate 25. When the coin is needed in the respective change tube, gate 77 is opened (as explained above). The coin falls past gate 77 and sensor CP3, which is located immediately below gate 77. As the coin falls past sensor CP3, the output of wave shaping circuit 207 is a pulse whose width corresponds to the time it takes the coin to fall past the sensor. This pulse is supplied to a one-shot 242 which in response to the positive-to-negative transition of the pulse, representing the trailing edge of the coin, supplies a short positive pulse to the reset input of latch 239, causing its $\overline{Q}$ output to go High. This turns off transistor Q3, thereby deenergizing the coil of gate-actuating solenoid 79 and returning gate 77 to its normal position.

Similarly, when a coin is directed to the cash box, it passes gate 25 and sensor CP4 which is located just downstream from that gate. As the coin passes sensor CP4, wave shaping circuit 209 generates a pulse which is supplied directly to the reset input of latch 233. This causes the Q output of the latch to go High, resulting in the deenergization of the coil of gate-actuating solenoid 104, and the return of gate 25 to its normal position in preparation for the next cycle.

Sensor CP3 also has an additional function, namely enabling the actuation of gate 171 to permit dimes to fall past gates 77 and 171 directly into the dime change tube DT (FIGS. 15–17). Gate 171, which is directly above the dime change tube, is actuated by a circuit 243 which includes the coil of gate-actuating solenoid 177 and an NPN transistor Q5 connected between said coil and ground. When a dime is deposited in the vendor it is detected and validated by the detector 65 and output line 213 goes High. This High is supplied to flip-flop 219 as are all other valid coin signals, but is is also supplied to an AND gate G33. The outher input to AND gate G33 is supplied via an inverter 245 from NOR gate 237. The output of NOR gate 237 is Low, and hence the input to AND gate G33 is High, only when dimes are needed in the dime change tube. Consequently, the output of AND gate G33 is High if and only if a dime has been deposited in the vendor and that dime is needed in the change tubes. When dimes are not needed in the change tubes, AND gates G33 does not pass any signal and the apparatus operates as described above; gate 77 remains in its normal position and gate 25 is actuated to allow the dime to pass to the cash box.

When, however, a dime is needed in the dime change tube DT, the output of AND gate G33 is High. This High is supplied via an inverter 247 to the clock input of a latch 249, causing its $\overline{Q}$ to go High. The High Q output of latch 249 is supplied to an AND gate G35 whose other input is connected to sensor CP3 and circuit 207. When the dime reaches sensor CP3, this input to AND gate G35 goes High, causing its output to go High, thereby triggering a one-shot 251. The resulting output of one-shot 251, a positive pulse of sufficient duration to allow the dime to fall past gate 77, is supplied through a buffer 253 to the base of transistor Q5, causing it to conduct. This energizes the coil of solenoid 177, thereby opening gate 171 and allowing the dime to fall unimpeded into the dime change tube. When one-shot 251 times out, the High signal is removed from the base of transistor Q5 and gate 171 returns to its normal position. Latch 249 is reset for the next dime by a High pulse supplied to its reset input from one-shot 242 at the end of the pulse from CP3 and circuit 207.

As to the first embodiment of the apparatus, which does not include gate 171, the circuitry for actuating that gate may be omitted if desired. In that case, the circuitry would be identical to that shown in FIGS. 18A and 18B except that inverters 245 and 247, AND gates G33 and G35, latch 249, one-shot 251, buffer 253, transistor Q5, and the rest of gate-actuating circuit 243 would be omitted.

Circuit 201 also includes a scavenge switch 255, operable by the customer, connected to the reset input of flip-flop 219. When switch 255 is actuated, flip-flop 219 is reset in preparation for the next coin. However, it should be noted that this switch does not affect any gate which happens to be open when the switch is pressed. This allows a coin which is passing a gate when the scavenge switch is pressed to clear the gate rather than be caught therein.

From the above, it will be observed that nickels inserted in the coin slot 2 of the vendor in which the coin apparatus 1 is used are delivered to the nickel change tube NT as long as the latter is not filled with nickels up to the level of sensor NS. Dimes inserted in the slot 2 are delivered to the dime change tube DT as long as the latter is not filled with dimes up to the level of sensor DS. Quarters inserted in the slot 2 are delivered to the quarter change tube QT as long as the latter is not filled with quarters up to the level of sensor QT. Dollar coins inserted in the slot 2 are delivered to the dollar coin change tube DCT as long as the latter is not filled with dollar coins up to the level of sensor DCS. In each of the above cases, gate 77 is opened to allow the coin to drop out into the coin sorting means 9, without proceeding on to the stated second reach or chute 85. The level of the sensor for each tube may be readily changed to change the number of coins which may be accumulated in the tube by removing it from the sensor mount 133 on the tube in which it has previously been placed and socketing it in the other mount 133 on the tube.

Nickels inserted in slot 2 are delivered to the money box 3 when the nickel change tube NT is full up to the level of sensor NS. Dimes inserted in slot 2 are delivered to the money box when the dime change tube DT is full up to the level of sensor DS. Quarters inserted in slot 2 are delivered to the money box when the quarter change tube QT is full up to the level of sensor QS. Dollar coins inserted in slot 2 are delivered to the money box when the dollar coin change tube DCT is full up to the level of sensor DCS. In each of these cases, gate 77 remains closed to send the coin down chute 85 toward the gate 25, and gate 25 is swung to its second position (shown in phantom in FIG. 7) for delivering the coin to the money box 3.

Unacceptable items (slugs, unacceptable U.S. coins, and foreign coins) have no effect on circuit 201, and gate 77 remains in its normal closed position, and gate 25 remains in its normal first position (shown in solid lines in FIG. 7) for sending the item into chute 64 and thence to the return system 23 and into the return cup C of the vendor.

As to the embodiment of FIGS. 15–17, it will be observed that, as shown, this permits wider spacing of the change tube than the FIGS. 1–16 embodiment. It is also possible that the four change tubes may be kept within the confines of the sides 41 and 43 of the housing 45, utilizing a dollar-coin-diameter-related opening downstream from the quarter opening for sorting out dollar coins, and it is further possible that if only nickel, dime and quarter change tubes are used, the width of the apparatus (between sides 41 and 43) may be reduced. A further advantage of the embodiment of FIGS. 15–17 is that it enables sorting coins of two different denominations which are of only slightly different diameter, or which may even have the same diameter.

Finally it is to be observed that the coin apparatus is such that if the power to the vendor in which it is used and hence the power to the coin apparatus is off, gate 77 is closed and gate 25 is in its return position so that any coins deposited in the coin slot 2 of the vendor are returned. This is important as to any electrically operated vendor since, with power off, there can be no vend.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Coin apparatus for use in a vendor for handling acceptable coins and rejecting unacceptable items inserted in the coin slot of the vendor and for making change, comprising:

a plurality of change tubes, one for each of a plurality of denominations of acceptable coins that may be inserted in the coin slot of the vendor, each of said tubes being adapted to hold a stack of coins of a respective denomination, and being open at the top for being filled with coins from the top;

a plurality of sensors. one for each change tube, for sensing the filling of each tube with coins of the respective denomination to a predetermined level in the tube;

coin sorting means for sorting coins of said denominations and delivering to each change tube coins of the denomination for that tube, said sorting having an entrance for coins of the different denominations to be sorted;

means for effecting delivery of coins of each of said denominations inserted in the coin slot of the vendor to the coin sorting means as long as the change tube for coins of that denomination is not filled to the respective predetermined level, for effecting delivery of coins of each of said denominations inserted in the coin slot of the vendor to an accept system when the change tube for coins of that denomination is filled with coins to the respective predetermined level, and for effecting delivery of unacceptable items inserted in the coin slot of the vendor to a return system of the vendor, said delivery means comprising:

guide means movable between a first position for effecting travel of unacceptable items to the return system of the vendor and a second position for effecting travel of acceptable coins to the accept system, said guide means normally occupying its first position;

passage means for travel of acceptable coins and unacceptable items inserted in the coin slot of the vendor to said guide means;

means along said passage means for detecting whether an item travelling therein is an acceptable coin or an unacceptable item and, if it is an acceptable coin, detecting its denomination; means between said detecting means and said guide means for exit of coins from said passage means to said coin sorting means, said exit means being normally closed;

means responsive to the sensor of a change tube detecting the level of coins therein as below the respective predetermined level and to the detecting means detecting the passage of a coin of the respective denomination in said passage means for opening said exit means for delivery of the coin to the coin sorting means; and means responsive to the sensor of a change tube detecting the level of coins in the tube as above the respective predetermined level and to the detecting means detecting the passage of a coin of the respective denomination in said passage means for moving said guide means to its second position for delivery of the coin to the accept system.

2. Coin apparatus as set forth in claim 1 wherein said passage means is inclined for rolling of items received from the coin slot of the vendor toward said exit means and for ongoing rolling of items to said guide means from said exit means when the latter is closed.

3. Coin apparatus as set forth in claim 2 wherein said passage means has a first reach down which items roll toward said exit means and a second reach on which items roll away from said exit means, coins dropping out into said sorting means without proceeding on to said second reach when the said exit means is opened.

4. Coin apparatus as set forth in claim 3 wherein said exit means comprises an exit gate movable between an open and a closed position and normally closed, and said guide means comprises an accept/return gate movable between said first position for travel of unacceptable items to the return system of the vendor and said second position for travel of acceptable coins to the accept system and normally occupying its first position.

5. Coin apparatus as set forth in claim 4 wherein the exit gate is located at one side of the apparatus, the passage means has a first reach inclined downwardly from the other side of the apparatus for rolling of items down toward this exit gate and a second reach below the first inclined downwardly toward the other side away from the exit gate, said accept/return gate being located along said second reach and said accept/return gate being downstream from said exit gate along said second reach.

6. Coin apparatus as set forth in claim 5 wherein said coin sorting means comprises a coin sorting passage extending below said second reach inclined downwardly from said one side of said apparatus toward the other and having its upper end below said exit gate.

7. Coin apparatus as set forth in claim 6 wherein said exit gate, in its closed position, forms a bottom for said passage means inclined downwardly toward the upper end of said second reach.

8. Coin apparatus as set forth in claim 7 wherein said second reach has a rear outlet for rear exit of items to said return system and said accept/return gate is movable between a return position wherein it blocks the second reach and guides items out through said rear outlet and an accept position wherein it allows coins to travel on down the second reach.

9. Coin apparatus as set forth in claim 3 wherein said first reach of said passage means is formed by inclined rail means and a pair of panels forming an inclined chute.

10. Coin apparatus as set forth in claim 9 wherein the rail means is on one of the panels and said one panel with the rail means is movable away from the other panel for scavenging.

11. Coin apparatus as set forth in claim 9 wherein said chute is inclined off vertical for items to roll down the chute in face-to-face engagement with said other panel, and said detecting means is on said other panel.

12. Coin apparatus as set forth in claim 5 wherein said second reach of said passage means is formed by inclined rail means and a pair of panels forming an inclined chute, and said accept/return gate is pivoted in an opening in one of said panels for movement from a return position wherein it directs items out through said opening and an accept position wherein it closes the opening and allows items to roll on down in said chute.

13. Coin apparatus as set forth in claim 12 having an exit from said chute for travel of coins to the accept system in one of said panels downstream from the accept/return gate.

14. Coin apparatus as set forth in claim 1 having change tubes for U.S. nickels, dimes, quarters and dollar coins.

15. Coin apparatus as set forth in claim 1 wherein the sensor on at least one of the change tubes is positionable at different levels on the change tube.

16. Coin apparatus as set forth in claim 15 wherein the sensor on each change tube comprises a light-emitting diode and a phototransistor, the light-emitting diode directing a beam of light toward the phototransistor across a chord of the circle defined by the inner circumference of the change tube.

17. Coin apparatus as set forth in claim 16 wherein each change tube has a sensor mount having sockets receiving the light-emitting diode and phototransistor.

18. Coin apparatus as set forth in claim 17 wherein at least one change tube has sensor mounts at different levels.

19. Coin apparatus as set forth in claim 6 wherein said coin sorting passage has a bottom exit for drop-out of coins of one denomination into the respective change tube and a sorting gate normally closing said bottom exit, and means for opening said sorting gate for drop-out of a coin of said one denomination from said coin sorting passage.

20. Coin apparatus as set forth in claim 19 wherein said bottom exit and sorting gate of the coin sorting means are under the said exit gate at the upstream end of said coin sorting passage.

21. Coin apparatus as set forth in claim 20 wherein said coin sorting passage has lateral coin-diameter-related exit openings for coins of denominations other than said one denomination.

22. Coin apparatus as set forth in claim 21 wherein said coin sorting passage has an end exit at its downstream end for end exit of coins of another denomination.

23. Coin apparatus as set forth in claim 22 having change tubes for U.S. nickels, dimes, quarters and dollar coins, the dimes being sorted by said sorting gate, the nickels and quarters by lateral coin-diameter-related exit openings, and the dollar coins rolling out of said end exit.

24. Coin apparatus as set forth in claim 6 wherein said coin sorting passage has means below the exit gate for dampening the fall of a coin into the coin sorting means.

25. Coin apparatus for use in a vendor for handling acceptable coins and rejecting unacceptable items inserted in the coin slot of the vendor and for making change, comprising:

a plurality of change tubes, one for each of a plurality of denominations of acceptable coins that may be inserted in the coin slot of the vendor, each of said tubes being adapted to hold a stack of coins of a respective denomination, and being open at the top for being filled with coins from the top;

a plurality of sensors, one for each change tube, for sensing the filling of each tube with coins of the respective denomination to a predetermined level in the tube;

coin sorting means for sorting coins of said denominations and delivering to each change tube coins of the denomination for that tube, said sorting means having an entrance for coins of the different denominations to be sorted, exits for drop-out of coins of the different denominations into the respective tubes, and a sorting gate for one of said exits, passage means for travel of acceptable coins and unacceptable items inserted in the coin slot of the vendor toward the coin sorter entrance, means along said passage means for detecting whether an item travelling therein is an acceptable coin or an unacceptable item and, if it is an acceptable coin, determining its denomination; and means controlled by said detecting means for effecting delivery of coins of each of said denominations inserted in the coin slot of the vendor to the coin sorting means in response to the sensor for the change tube for coins of that denomination detecting the level of coins therein as below the respective predetermined level, for effecting opening of said sorting gate if the coin delivered to the coin sorting means is a coin of said one denomination for drop-out of the coin into the respective change tube, for effecting delivery of a coin inserted in the coin slot of the vendor to an accept system in response to the sensor for the change tube for coins of that denomination detecting the level of coins therein as above the respective predetermined level, and for effecting delivery of an unacceptable item to a return system of the vendor.

* * * * *